US012673249B2

(12) United States Patent
Bijl et al.

(10) Patent No.: US 12,673,249 B2
(45) Date of Patent: Jul. 7, 2026

(54) DEVICE FOR PLACING A BASKETBALL NET

(71) Applicant: 8EIGHTS EOOD, Staro Myasto (BG)

(72) Inventors: Marc Alastair Bijl, Maassluis (NL); Charles Franciscus Joseph Beuker, Maassluis (NL)

(73) Assignee: 8EIGHTS EOOD, Staro Myasto (BG)

( * ) Notice: Subject to any disclaimer, the term of this patent is extended or adjusted under 35 U.S.C. 154(b) by 347 days.

(21) Appl. No.: 18/573,113

(22) PCT Filed: Jun. 21, 2022

(86) PCT No.: PCT/NL2022/050354

§ 371 (c)(1),
(2) Date: Dec. 21, 2023

(87) PCT Pub. No.: WO2022/271019

PCT Pub. Date: Dec. 29, 2022

(65) Prior Publication Data

US 2024/0293721 A1 Sep. 5, 2024

(30) Foreign Application Priority Data

Jun. 25, 2021 (NL) ..... 2028546

(51) Int. Cl.
*A63B 71/00* (2006.01)
*A63B 63/08* (2006.01)

(52) U.S. Cl.
CPC ..... *A63B 71/0036* (2013.01); *A63B 63/083* (2013.01)

(58) Field of Classification Search
CPC ..... A63B 71/0036; A63B 63/083
See application file for complete search history.

(56) References Cited

U.S. PATENT DOCUMENTS 4,805,903 A * 2/1989 McArdle ..... A63B 63/083 473/489
5,123,642 A 6/1992 Stokes
(Continued)

FOREIGN PATENT DOCUMENTS

AU 2010101415 A4 1/2011
CN 206660520 U * 11/2017
CN 206715223 U * 12/2017
(Continued)

OTHER PUBLICATIONS

PCT International Search Report dated Aug. 30, 2022; PCT/NL2022/050354.

*Primary Examiner* — Jeffrey D Carlson
(74) *Attorney, Agent, or Firm* — Suiter Swantz IP

(57) ABSTRACT

The invention relates to a device (1) for placing a basketball net (2), comprising:

a housing (3, 14) with a storage space (4, 16) for storing the basketball net, wherein the basketball net is stored in the storage space, the basketball net comprising a plurality of attachment members (5, 12) for releasable attachment of the basketball net to a lower side of a basketball hoop, an extension mechanism (8) for extending the basketball net from the storage space through an opening (9) in the housing towards the basketball hoop, in order to releasably attach the plurality of attachment members and the basketball net to the basketball hoop.

12 Claims, 4 Drawing Sheets

(56) References Cited

U.S. PATENT DOCUMENTS

| | | | | |
|---|---|---|---|---|
| 6,440,014 | B1 * | 8/2002 | Checko | A63B 63/083 473/485 |
| 2017/0239543 | A1 * | 8/2017 | Seto | A63B 71/0622 |

FOREIGN PATENT DOCUMENTS

| | | | |
|---|---|---|---|
| DE | 9306917 | U1 | 8/1993 |
| GB | 2334896 | A | 9/1999 |

* cited by examiner

DEVICE FOR PLACING A BASKETBALL NET

FIELD OF THE INVENTION

The present invention generally relates to a device for placing a basketball net, as well as a method for attaching a basketball net to a lower side of a basketball hoop and/or for removing a basketball net from a lower side of a basketball hoop.

BACKGROUND OF THE INVENTION

AU 2010101415 A4 discloses a net assembly that can be attached to and detached from a scoring hoop. DE 9306917 U1 discloses a device for holding a basketball hoop. U.S. Pat. No. 5,123,642 A1 discloses a net attachment for a basketball hoop. US 2017/0239543 A1 discloses an illuminated basketball hoop accessory. GB 2334896 A discloses a portable goal and net.

"Conventional" basketball hoops, such as steel basketball hoops, as well as conventional basketball nets are known in the art. A basketball hoop is fixed directly to a vertical backboard connected to a pole, wall or frame at playing height, known collectively as a "basketball system". A conventional basketball net is suspended from a steel basketball hoop by twelve integrated rim hooks under the hoop. Some basketball hoops, especially outdoors, do not have rim hooks, and hence lack proper means for suspending a basketball net. These basketball hoops are in effect "smooth" underneath.

The absence of such a basketball net is a big dissatisfies when playing basketball, because the basketball net funnels the ball and slows the ball down. Not having a basketball net increases the chance of incorrect score-keeping. Additionally, the ball could leave the court, which could result in the ball it getting lost, dirty, damaged, resulting in a delay of game as the ball needs to be retrieved, cleaned or replaced. Placing a basketball net onto the rim of conventional basketball hoops is difficult and time consuming because of the height of a basketball hoop above the ground. Also, the basketball net needs to be connected to the rim on twelve individual points. Often the rim hooks are even absent. The height of the hoop poses an additional problem as, conventionally, a basketball net is hung at 3.05 meters above ground level (i.e. 10 feet, in US/non-SI units), making them unreachable without a ladder or other climbing device. Additionally, it is quite time-consuming to thread the twelve individual top loops of the basketball net through the net/rim hooks. In many cases, the basketball net of a conventional basketball hoop is never replaced (when broken), removed or stowed away—or even placed to begin with. If the nets are not replaced by the owner (often the case with public courts), it is less inviting and pleasurable to play basketball for the reasons stated above.

An object of the present invention is to provide a person with the ability to place a basketball net to any (in particular steel) basketball hoop at a height of 3.05 meters above ground level. Further objects of the invention are to provide a person with the ability to retrieve (from the basketball hoop), store, and/or transport such a basketball net.

SUMMARY OF THE INVENTION

Thereto, a device for placing a basketball net is provided, comprising:

a housing with a storage space for storing the basketball net, wherein the basketball net is stored in the storage space, the basketball net comprising a plurality of attachment members for releasable attachment of the basketball net to a lower side of a basketball hoop, an extension mechanism for extending the basketball net from the storage space through an opening in the housing towards the basketball hoop, in order to releasably attach the plurality of attachment members and the basketball net to the basketball hoop.

Such a device is easy to use, and allows the person to easily attach the basketball net to a lower side of the (any) (in particular steel) basketball hoop. The person can attach the basketball net with ease, avoiding damage to the ball, loss of time and increasing the experience of play. The device will also help with overcoming the height difference between himself/herself and the basketball hoop. Furthermore, the device allows safe storage of the basketball net when not used. The plurality of releasable attachment members also allow for easy and damage-free placement and removal of the basketball net from the hoop. When fully extended, the releasable attachment members are arranged in a ring-shape (or form a ring-shape) conforming to the ring-shape of the basketball hoop.

An embodiment relates to an aforementioned device, further comprising:

a retraction mechanism for retracting the basketball net from the basketball hoop.

Such a retraction mechanism allow the person to easily remove the basketball net again from the hoop in order for the basketball net to be stored. The retraction mechanism can thus be advantageously used to "pull" the basketball net from the hoop, allowing the user to again store the basketball net in the storage space. The plurality of releasable attachment members ensure damage-free removal of the basketball net from the hoop.

An embodiment relates to an aforementioned device, wherein the attachment members comprise magnets. Usually, the hoop is made of steel. Magnets 5 therein provide an advantageous way of guaranteeing releasability of the attachment members. Furthermore, magnets can be used again and again (as well as the attached basketball net), without decreasing the aforementioned releasability.

An embodiment relates to an aforementioned device, wherein the basketball net is provided with a plurality of rim hooks, wherein the basketball net is configured to be suspended from the rim hooks during use, wherein each of the plurality of attachment members is connected to a rim hook. Thus, it is not necessary to separately attach rim hooks. By providing rim hooks (as normally provided with a conventional basketball system, but often missing from e.g. outdoors basketball hoops), from which the basketball net is to be suspended, the natural feel of the basketball net is maintained.

An embodiment relates to an aforementioned device, wherein the basketball net comprises 3-20, preferably 4-15, more preferably 12 attachment members and/or, when provided with rim hooks, 3-20, preferably 4-15, more preferably 12 rim hooks to replicate the conventional basketball system as closely as possible, further improving the "natural feel" of the basketball net.

An embodiment relates to an aforementioned device, wherein the housing has a tubular shape, wherein the opening in the housing is provided at a longitudinal end of the tubular shape. The tubular shape may help relatively short persons to extend the basketball net towards the basketball hoop, normally positioned at 3.05 m above ground level.

Furthermore, such a tubular device is easy to transport, store and carry around. Of course, also relatively average-height or tall persons may benefit from such a shape. Other shapes are also conceivable though.

An embodiment relates to an aforementioned device, wherein the storage space has a cylindrical shape. Analogous to the device having a tubular shape, the storage space itself may also have a cylindrical shape. Such a cylindrical shape is advantageous for storing a basketball net, because both the cylindrical shape as well as the basketball net have a high degree of axial (rotational) symmetry, allowing for intuitive collapsing of the basketball net in the storage space, without folding the basketball net in an "unnatural" way, although other shapes are also conceivable.

An embodiment relates to an aforementioned device, wherein the extension mechanism is configured for operation as a collapsing mechanism for collapsing the basketball net into the storage space through the opening in the housing, thus guaranteeing easy "re-storing" of the basketball net.

Another aspect of the invention relates to a method for attaching a basketball net to a lower side of a basketball hoop and/or for removing a basketball net from a lower side of a basketball hoop, using an aforementioned device, comprising the steps of:

extending the basketball net with the extension mechanism from the storage space through the opening in the housing towards the basketball hoop, in order to releasably attach the plurality of attachment members and the basketball net to the basketball hoop.

In an embodiment, the method comprises the further step of, when a retraction mechanism is present:

retracting the basketball net from the basketball hoop with the retraction mechanism.

In an embodiment, the method comprises the further step of:

operating the extension mechanism as a collapsing mechanism for collapsing the basketball net into the storage space through the opening in the housing.

BRIEF DESCRIPTION OF THE DRAWINGS

The invention will be explained by means of the exemplary embodiments depicted in the accompanying drawings and the detailed description of the Figures below.

DETAILED DESCRIPTION

Figure 5:
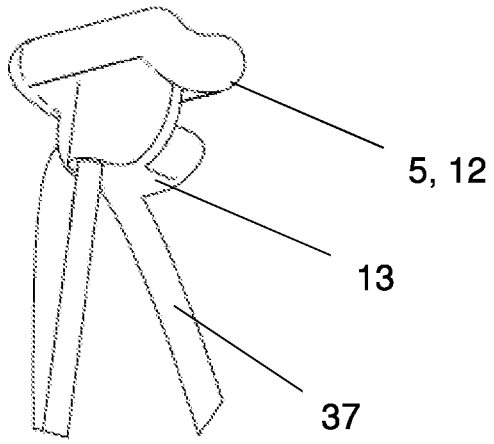
FIG. 5 shows an exemplary embodiment of a releasable attachment member comprising a magnet for releasable connection to a lower side of a basketball hoop.

As will be shown with respect to FIGS. 1-5 (which will be discussed in conjunction), and as discussed in the foregoing, the Applicant has come up with a device 1 for placing a basketball net 2, comprising a housing 3 with a storage space 4 for storing the basketball net 2, wherein the basketball net 2 is stored in the storage space 4. The basketball net 2 comprises a plurality of attachment members 5 for releasable attachment of the basketball net 2 to a lower side 6 of a basketball hoop 7. An extension mechanism 8 is provided for extending the basketball net 2 from the storage space 4 through an opening 9 in the housing 3 towards the basketball hoop 7, in order to releasably attach the plurality of attachment members 5 and the basketball net 2 to the basketball hoop 7. When fully extended, the releasable attachment members 5 are arranged in a ring-shape (or form a ring-shape) conforming to the ring-shape of the basketball hoop 7. A retraction mechanism 10 may be provided for retracting the basketball net 2 from the basketball hoop 7, in order to enable the user to again store the basketball net 2 in the storage device 1. Preferably, the attachment members 5 comprise magnets 12. The magnets 12 may have a curved shape to provide a snug fit with the basketball hoop 7 (i.e. curved around the circular cross-section of the hoop 7 and/or curved to match the circular shape of the hoop 7, as shown in FIG. 5). The basketball net 2 may be provided with a plurality of rim hooks 13, wherein the basketball net 2 is configured to be suspended from the rim hooks 13 during use, wherein each of the plurality of attachment members 5 is connected to a rim hook 13. Preferably, the basketball net 2 comprises 3-20, more preferably 4-15, most preferably 12 attachment members 5 and/or a similar number of rim hooks 13. The housing 3 may have a tubular shape 14, wherein the opening 9 in the housing is provided at a longitudinal end 15 of the tubular shape 14. Analogously, the storage space 4 may also have a cylindrical shape 16 (although other shapes are also conceivable).

Placing the Basketball Net 2

The placement device 1 extends the reach of a person (for instance by about 1.50 meters for the device 1 as illustrated, although the skilled person will understand that the placement device 1 may have a different length), allowing the user to comfortably place the basketball net 2 at the lower side 6 the basketball hoop 7 at a playing height of 3.05 meters. This may be defined as the "working position".

The extension of the placement device 1 and the placement of the basketball net 2 is achieved by using the extension mechanism 8 and applying the following steps in consecutive order (please refer to FIG. 3) in the following way:

1. Remove the top lid 26;
2. With one hand, twist the outer tube 17 counter-clockwise with one hand by a handgrip 39 (provided at the bottom 38 of the outer tube 19); with the other hand, hold the top ring 24 in a fixed position,
3. The placement device 1 can be extended by pulling the outer tube 17 downwards. Once the maximum length is achieved,
4. A clockwise twist will secure the outer tube 17 to the middle tube 18. The placement device 1 is now in the extended "working position".
5. Next, the user pushes the slide ring 21 upwards by pushing up and out the rod assembly 20, 21, 22, 23, 28, 29 to the maximum extended position. This brings out the basketball net 2 from the inner tube 19.
6. Turning the top turn ring 25 will spread the upper rods 23 at the hinging point of the lower rods 22 thus widening the basketball net 2 to match the circumference of the basketball hoop 7 onto which the basketball net 2 will be placed.

7. Once placed against the basketball hoop 7 the stronger magnetic pull from the metal in the basketball hoop 7 will "outpull" the magnetic pull of the metal tips 29, allowing a transfer of the magnet sachets 31 from the metal tips 29 to the basketball hoop 7, consequently securing the basketball net 2 to the basketball hoop
7. Once the basketball net 2 has been placed on the basketball hoop 7, the user reverses steps 6 back to 1 to reconfigure the invention into a "closed position" until the user wishes to retrieve the basketball net 2. Therein, the releasable attachment members 5 may thus comprise magnets 12, which in turn may include the magnetic sachets 31, as depicted. Other types of releasable attachment members 5, with similar functionality, may also be conceivable.

Recovery of the Basketball Net 2

The placement device 1 in the "closed position" is ready for transport and/or storage, with the hooks 27 folded inwards at the bottom 38 of outer tube 17, and the top lid 26 fastened closing the placement device 1. The components of the placement device 1 are secured and protected. This allows for easy transportation in, for example, a sports bag without the risk of damage to either the placement device 1 or the bag or its contents. With a diameter of e.g. 5-15 cm, such as 7.5-12.5 cm, for instance 10.4 cm (as shown) and a length of e.g. 45-65 cm, such as 50-60 cm, for instance 58.5 cm (as shown), the placement device 1 will easily fit into a conventional sports bag. An alternative means of transportation is by simply by carrying the invention by the strap 35 in one's hand or slung around one's shoulder. The strap 35 is connected at one end to the bottom 38 of the outer tube 17 and the top lid 26 on the top by the two strap rings 33 and snap hooks 34.

When the user wishes to retrieve and store the basketball net 2 steps 1 to 6 are repeated. Subsequently:

8. The placement device 1 is then turned upside down and
9. The hooks 27 are rotated out 90 degrees and are used
10. To hook into the bottom of the mounted basketball net 2.
11. A sturdy downward tug on the placement device 1 sufficiently strong to out pull the magnetism of the hoop 7 will release the basketball net 2 from the hoop 7.
12. The user then removes the basketball net 2 from the hooks 27 and rotates the hooks 27 back into their original position.

Re-Loading the Basketball Net 2 into the Placement Device 1

13. The user reverses steps 4 back to 2. The extension mechanism 8 may thus function as a sort of "collapsing mechanism" 11, so to speak.
14. The basketball net 2 can then be replaced into the inner (storage) tube 19.
15. Once the basketball net 2 is inside the inner/storage tube 19 the user places the twelve magnet sachets 31 onto the metal tips 29 and
16. Closes the placement device 1 by re-placing the top lid 26 in its original position.

Individual Components

Figure 1:
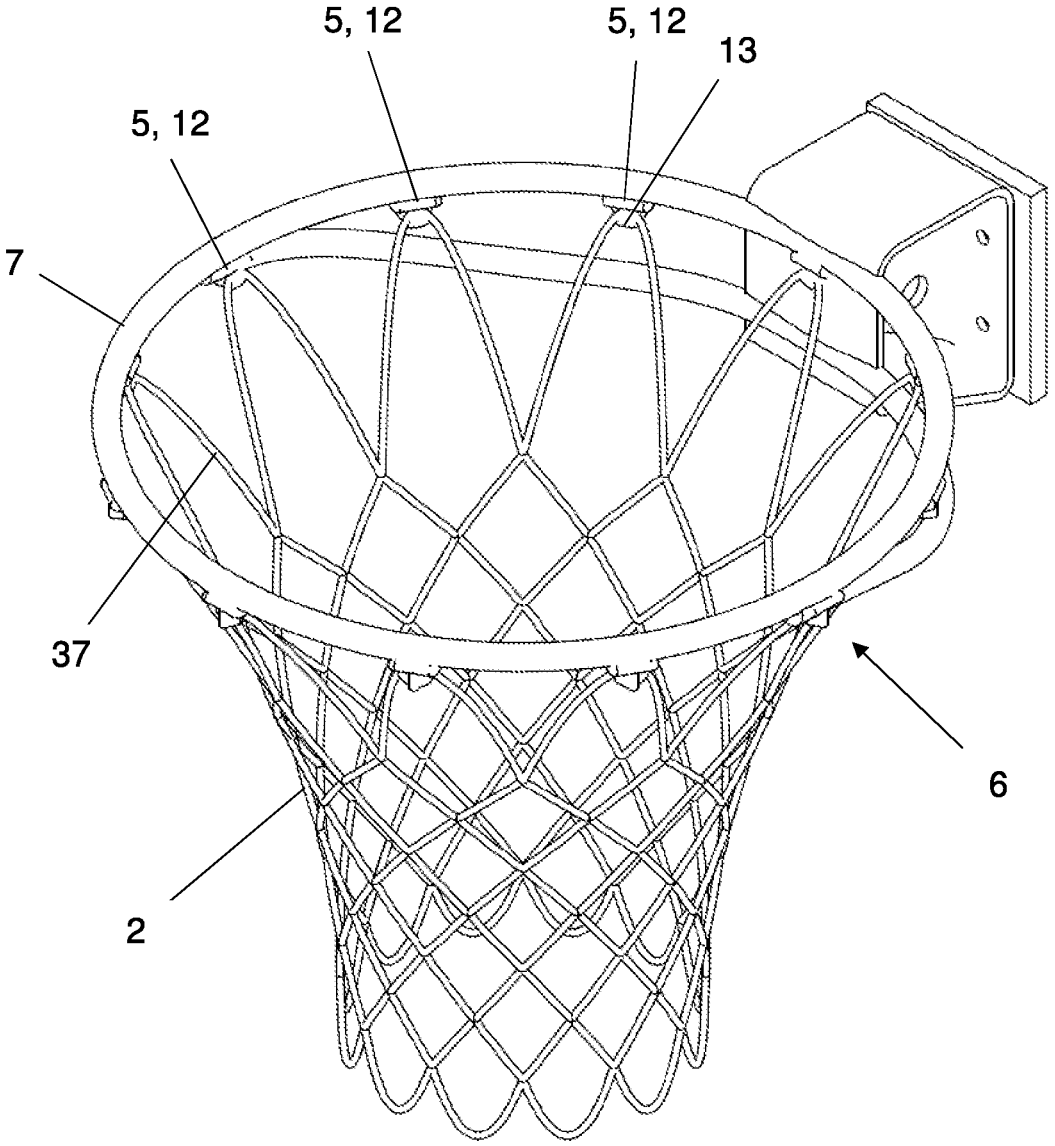
FIG. 1 shows an exemplary embodiment of a basketball net, wherein the basketball net is attached to a lower side of a basketball hoop by means of releasable attachment members (such as according to the present disclosure)
Figure 2:
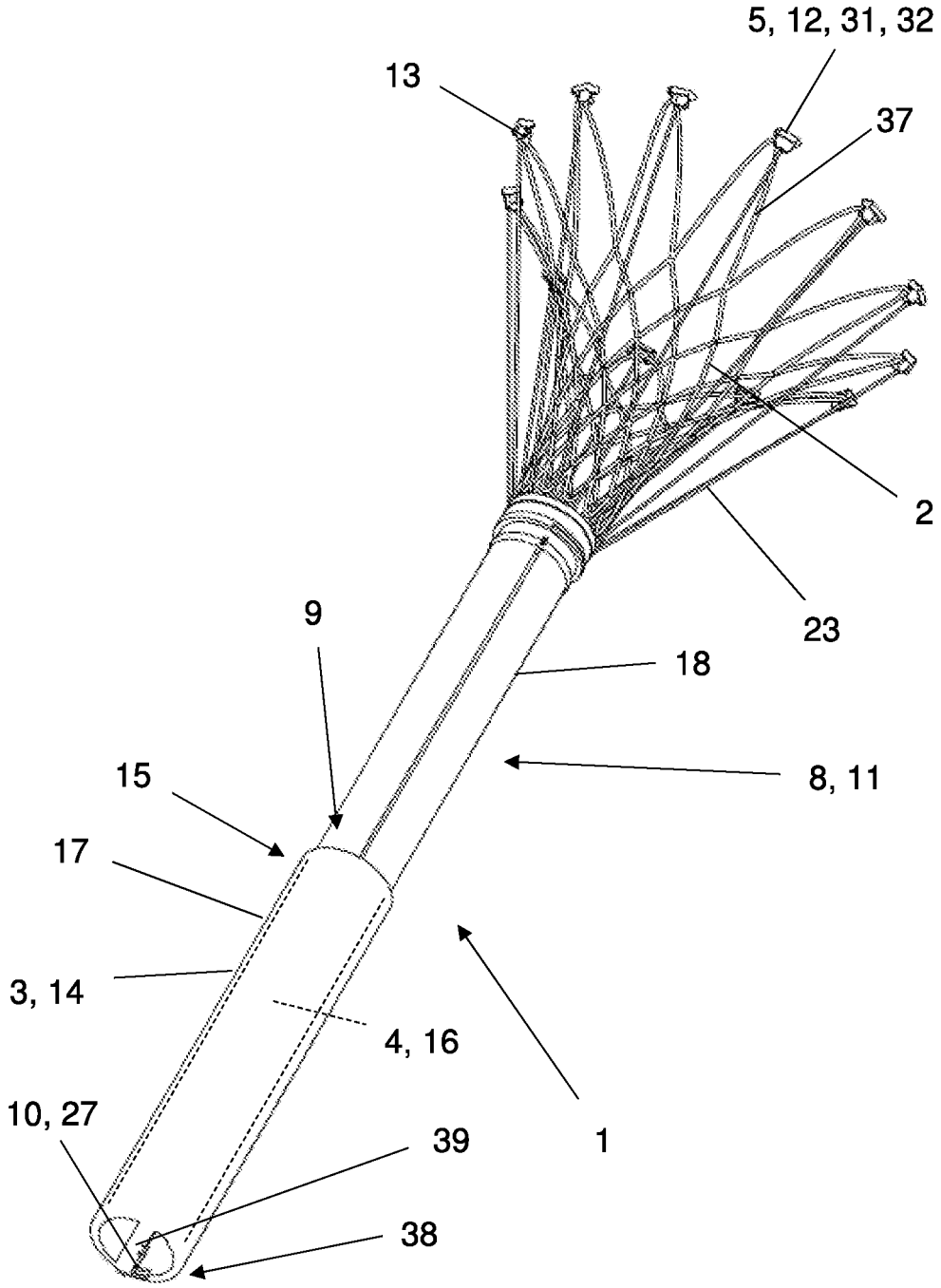
FIG. 2 shows an exemplary embodiment of the placement device, wherein the basketball net is shown in an extended state.

As mentioned before, FIG. 3 shows an exploded view of the placement device 1 of FIG. 2.

Figure 3:
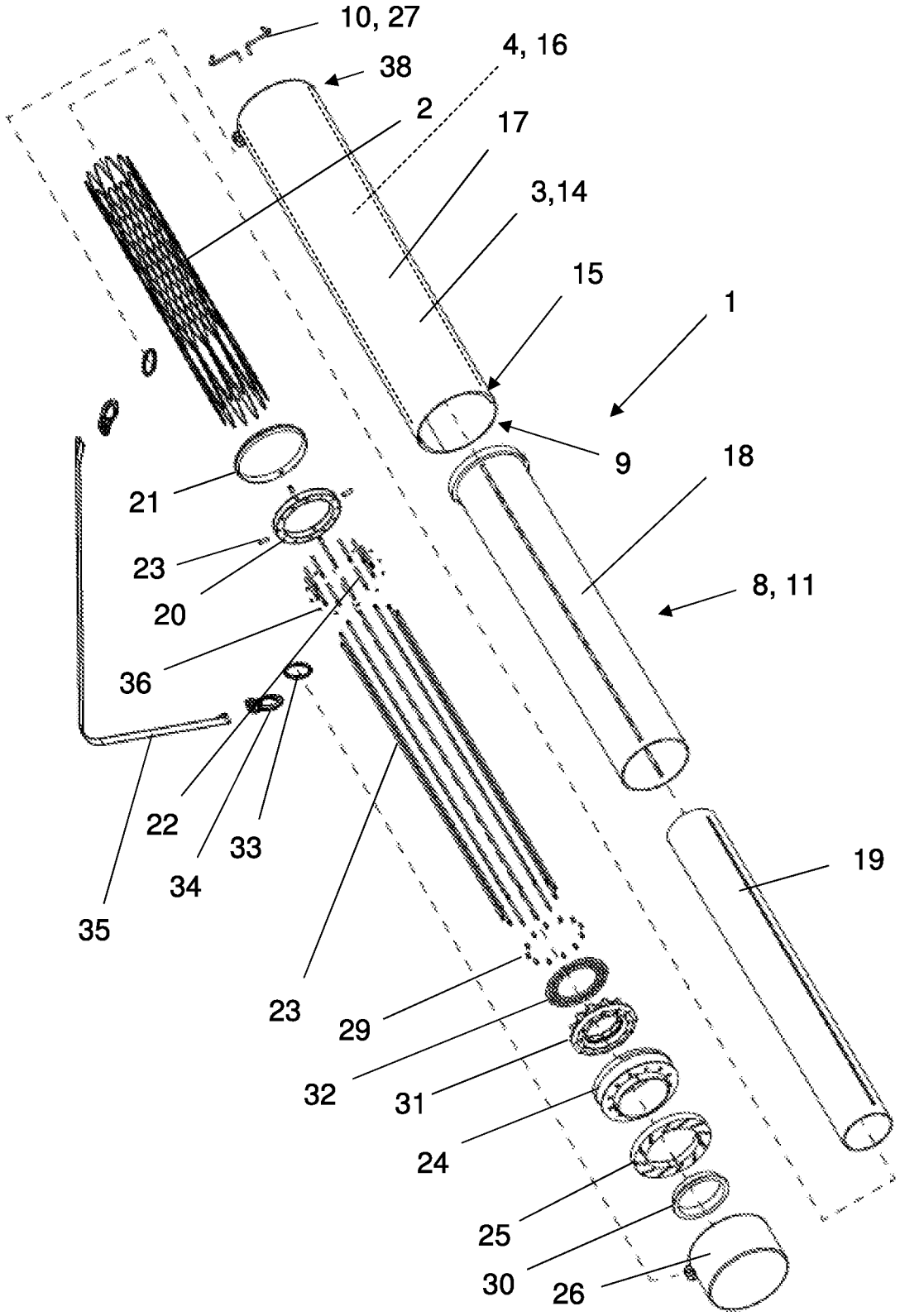
FIG. 3 shows an exploded view of the placement device of FIG. 2.
Figure 4:
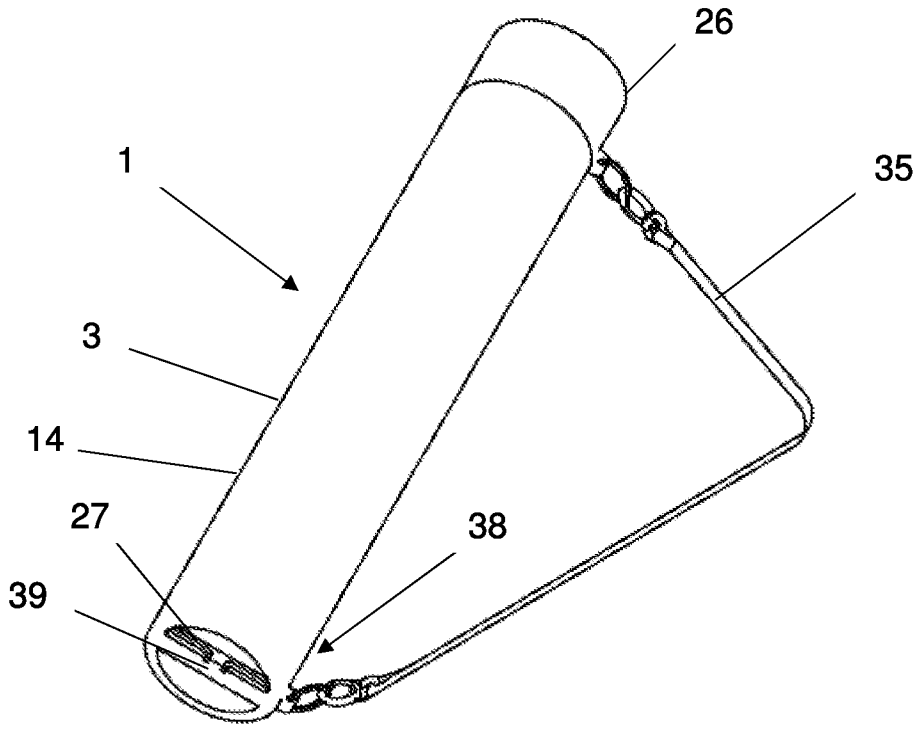
FIG. 4 shows a perspective view of the placement device according to FIGS. 2 and 3, wherein the basketball net is stored in the placement device.

The example placement device 1 as shown is made up of the following parts illustrated in FIG. 3. These parts will now be individually described, explaining their function and solution, and how they fit to the other parts of the placement device 1.

Outer Tube 17

The outer tube 17 forms the main outer shell of the placement device 1. The overall look of the placement device 1 is defined by the outer tube's 17 length and its cylindrical, smooth and robust exterior. With an example length of 52.9 cm and a diameter of 10.4 cm of the placement device 1 for the illustrated embodiment, ample surface area is provided for adding a logo/brand for marketing purposes. To fix the outer tube 17 into the top ring 24 a twisting motion is applied to "clamp" into the top ring 24. The inner thickening on both the top ring 24 and the outer tube 17 ensures a connection by friction as the separate parts are clamped into each other by this twisting motion. In order for the user to easily extend or retract the placement device 1, a handgrip 39 is located at the bottom 38 of the outer tube 17 in a cavity as an extrusion. The handgrip 39 will aid in the twisting motion needed to unclamp the outer tube 17 from the top ring 24, subsequently sliding it downwards, and exposing the middle tube 18, in order to extend and shorten the placement device 1 between its working position and closed position. The protection of the internal system is achieved by using a hard, light material. The integrated hole protruding at the bottom of the outer tube 17 is where the strap rings 33 can be connected by passing them through. At the bottom 38 of the outer tube 17 there are two holes where the hooks 27 are connected (not shown), and wherein the hooks 27 may rotate. In this embodiment, the retraction mechanism 10 as such is thus formed by the hooks 27, although other retraction means may also be conceivable.

Middle Tube 18

The middle tube 18 supports the outer tube 17 by providing rigidness due to the hardness of the used material in the closed position. Also, it provides overall structural integrity together with the top ring 24, supporting particularly the rod assembly 20, 21, 22, 23, 28, 29 and the outer tube 17 throughout the whole length. The bottom of the middle tube 18 connects through friction into the top of the outer tube 17 to fix in place when in the working position. The four slots along the length of the middle tube 18 guide the screws 28 when extending and retracting the rod assembly 20, 21, 22, 23, 28, 29, 36. The inner top end is used to connect the middle tube 18 to the top ring 24 through threading.

Inner (Storage) Tube 19

The inner tube 19 is the "most inner" tube of the placement device 1. Open on the top, closed at the bottom and hollow throughout, the basketball net 2 is stored inside the inner tube 19 when not in use. In order to guide and prevent rotation of rod assembly ring 20 there is a protrusion running along the length of the inner tube 19. By means of threading, the inner tube 19 is connected into the top ring 24.

The Rod Assembly 20, 21, 22, 23, 28, 29

The rod assembly parts 20, 21, 22, 23, 28, 29 together form the moving part of the placement device 1 (and thus the "core" of the extension mechanism 8), extending the rods 22, 23 for the shaping and placing of the basketball net 2 on the basketball hoop 7.

Rod Assembly Ring 20

The rod assembly ring 20 is located at the bottom of the rod assembly 20, 21, 22, 23, 28, 29 and is used to slide and guide it up and down. Tightly fitting between the inner tube 19 and the middle tube 18, the rod assembly ring 20 is moved by effort of the user. The twelve lower rods 22 are inserted into the twelve holes in the rod assembly ring 20. The rod assembly ring 20 remains vertical due to friction created by its tight fit around the inner tube 19. The four threaded holes are used to fasten the rod assembly ring 20 to the slide ring 21 by the insertion of the four screws 28. To prevent the rod assembly ring 20 from rotating, an anti-rotation slit slides along the protrusion on the inner tube 19.

Slide Ring 21

The slide ring 21 is used to extend and retract the rod assembly 20, 21, 22, 23, 28, 29 up and down by the user by gripping the slide ring 21 with his hand and pushing or pulling up or downwards. The slide ring 21 is connected to the rod assembly ring 20 and is fastened by four screws 28 that fit through four holes. The slide ring 21 is positioned and slides between the outer tube 17 and around the middle tube 18. The slide ring 21 fits loosely around the middle tube 18 to allow for it to be slid up and down by the user.

Lower Rod 22

The lower rod 22 is inserted into the rod assembly ring 20 fastening it securely in both the working position and the closed position. The hinging point connects to the upper rod 23 allowing it to angle outward into the working position to spread the basketball net 2 for placement under a hoop 7. In the middle of the hinging point there is a hole where the rod pin 36 is inserted connecting it to the upper rod 23.

Upper Rod 23

The upper rod 23 connects at the bottom end to the top of the lower rod 22 by fitting them together and then inserting the rod pin 36 through the hole and the hole of the lower rod 22. These same holes act as hinges to the top end of the lower rod 22 around the rod pin 36. On the top end of the upper rod 23, the metal tip 29 is fixed over the thinner part of the upper rod 23 specially fitted to be inserted and acting as a support for the magnet sachets 31.

Top Ring 24

The top ring 24 can be considered the central connection point of the placement device 1. When in the closed position the top ring 24 connects to and keeps the outer tube 17 in place by friction. When twisted clockwise the outer tube 17 is unclamped. Outer tube 17 is subsequently free to move up and down the placement device 1. When in the closed position, the top lid 26 closes off the placement device 1 from the top by connecting by means of treading. When the placement device 1 is transitioned between the working position and the closed position, the user can grip the placement device 1 in the middle of the top ring 24 due to its high-friction surface. When the upper rods 23 are spread by the user for the placing of the basketball net 2 by twisting the top turn ring 25, the four protrusions and the smooth, loose-fitting upper ring are there to guide rotation of the top turn ring 25, and simultaneously limit the rotation of the top turn ring 25. The inner tube 19 is connected into the top ring 24 by threading. Similarly, the middle tube 18 is connected by threading onto the top ring 24. Also, top close ring 30 is connecting into top ring 24 by threading into top ring 24 from the top. The twelve holes in the top ring 24 are there to guide the upper rods 23 when the rod assembly 20, 21, 22, 23, 28, 29 is moved up and down. When the rod assembly 20, 21, 22, 23, 28, 29 is in its most upper position, the upper rods 23 are free to pivot outwards, where the top ring 24 accommodates such pivoting by having sufficient space for the outward movement of the upper rods 23. The space is of an oblong shape, wherein the outward movement of the upper rods 23 is limited to meet the maximum outer diameter of the tips of the upper rods 23 corresponding with the diameter of the basketball hoop 7.

Top Turn Ring 25

With the high-friction surface, built-in finger grip the user can rotate the to turn ring 25. This allows for the spreading of the upper rods 23 that pivot in the helix-shaped holes to best match the circumference of the basketball hoop 7 the user wishes to place the basketball net 2 onto. This allows the placement device 1 to be used on any basketball hoop 7 made from a magnetic metal even if their size slightly varies from the standard circumference. On the inside of the top turn ring 25 there are four indented slots which limit rotation and fit over the four protrusions of the top ring 24.

Top Lid 26

The main purpose of the top lid 26 is to close off the placement device 1 by covering the top opening. By connecting to the top ring 24 by means of threading, the top lid 26 is securely fixed protecting the inner components of the placement device 1. On the side of the top lid 26 there is a protruding fixture with a hole that allows the strap rings 33 to be connected.

Hooks 27

The main function of the hooks 27 is the retrieval of the basketball net 2 by hooking them in to the bottom loops of the basketball net 2. The hooks 27 can be rotated to be in a stored or operational position by means of a 90 degree rotation at the point where they are connected to the bottom 38 of the outer tube 17.

Screws 28

The four screws 28 are conventionally available, threaded pins that connect the rod assembly ring 20 to the slide ring 21 by passing through these two parts at four equally spaced points fixing them securely together.

Metal Tip 29

The twelve metal tips 29 are fixed to the top end of the upper rods 23 and are made of a metal with magnetic properties. When in the closed position, the magnet sachets 31 rest on the metal tips 29 and are held in place by magnetism. When in the working position, the magnet spheres 32 remain connected to the metal tips 29 up to a point that the magnet sachets 31 are held against the steel rim of a basketball hoop 7 who's stronger magnetic pull will "outpull" that of the metal tips 29.

Top Close Ring 30

The top close ring 30 connects to the top ring 24 by means of threading. The wider top of the top close ring 30 ensures that the top turn ring 25 remains in position in an axial way due to its larger diameter cap. Herewith, top turn ring 25 is still able to make the required rotation.

Basketball Net 2

The basketball net 2 is a conventional, readily available and replaceable basketball net 2 with twelve top loops 37 usually made from nylon. The main purposes of the basketball net 2 is to funnel the basketball for the purposes as described in the foregoing. The top loops 37 are required to hang the basketball net 2 to the hoop 7 by clamping around the integrated slots of the magnet sachets 31. As the basketball net 2 is readily available, it can easily be replaced if damaged or lost.

Magnet Sachets 31 and Magnetic Spheres 32

The twelve magnet sachets 31 are what connects the basketball net 2 to the basketball hoop 7 by magnetism. By clamping the top loops 37 of the basketball net 2 into the integrated slots, the basketball net 2 is securely attached to the magnet sachets 31 for use and storage, but also removable as the slots have an opening to remove the net top loops 37. The twelve magnetic spheres 32 are held in twelve magnet sachets 31 (i.e. a total of 144 spheres 32 in a magnet sachet 31 made of fabric) create a strong magnetic field which, when held against a basketball hoop 7, will connect to the basketball hoop 7 by a stronger magnetism than the one being exerted by the metal tip 29. This will release the connection from the metal tips 29 when they are pulled out of the fitting cavity after the placement of the basketball net 2 connected to the magnet sachets 31. In the bottom of the magnet sachets 31 there are openings for the metal tips 29 to be inserted, loosely holding them both in the working position and the closed position.

Strap Rings 33, Strap/Snap Hooks 34, and Strap 35

The two strap rings 33 are conventional key rings that are connected on one side of the placement device 1 to the top lid 26 and on the other to the bottom 38 of the outer tube 17 through the integrated hole. The strap rings 33 also connect to either side of the strap 35 by the two strap/snap hooks 34 that can be connected and disconnected to the strap rings 33 by the user by hooking and unhooking. The strap 35 can be used to carry the placement device 1 by slinging it over the shoulder of the user. At each end of the strap 35 there are loops that the strap hooks 34 are connected to permanently.

Rod Pins 36

The twelve rod pins 36 allow a pivot motion to occur between the upper rods 23 and the lower rods 22 when the placement device 1 is being operated. The rod pins 36 connect through a hole in the bottom of the upper rods 23 and a hole in the top of the lower rods 22 as the rod pins 36 go through-and-through. The rod pins 36 are smooth and cylindrical—this allows for a pivoting motion when the placement device 1 is being operated.

LIST OF REFERENCE NUMERALS

1. Device for placing a basketball net
2. Basketball net
3. Housing
4. Storage space
5. Releasable attachment member
6. Lower side of basketball hoop
7. Basketball hoop
8. Extension mechanism
9. Opening in the housing
10. Retraction mechanism
11. Collapsing mechanism
12. Magnet
13. Rim hook
14. Tubular housing
15. Longitudinal end of tubular housing
16. Cylindrical storage space
17. Outer tube
18. Middle tube
19. Inner tube
20. Rod assembly ring
21. Slide ring
22. Lower rod
23. Upper rod
24. Top ring
25. Top turn ring
26. Top lid
27. Hook
28. Screw (DIN 913 M4)
29. Metal tip
30. Top close ring
31. Magnet sachets
32. Magnetic spheres
33. Strap ring
34. Snap hook
35. Strap
36. Rod pin
37. Top loop
38. Bottom of outer tube
39. Handgrip

The invention claimed is:

1. A device for placing a basketball net, comprising:

a housing with a storage space for storing the basketball net, wherein the basketball net is stored in the storage space, the basketball net comprising a plurality of attachment members for releasable attachment of the basketball net to a lower side of a basketball hoop; and an extension mechanism for extending the basketball net from the storage space through an opening in the housing towards the basketball hoop, in order to releasably attach the plurality of attachment members and therefore the basketball net to the basketball hoop.

2. The device according to claim 1, further comprising a retraction mechanism for retracting the basketball net from the basketball hoop.

3. The device according to claim 1, wherein the attachment members comprise magnets.

4. The device according to claim 1, wherein:

the basketball net includes a plurality of rim hooks;

the basketball net is configured to be suspended from the rim hooks during use; and each of the plurality of attachment members is connected to one of the rim hooks.

5. The device according to claim 4, wherein the basketball net includes between three and twenty rim hooks.

6. The device according to claim 1, wherein the basketball net includes between three and twenty attachment members.

7. The device according to claim 1, wherein:

the housing is a tube; and the opening in the housing is provided at one end of the tube.

8. The device according to claim 1, wherein the storage space has a cylindrical shape.

9. The device according to claim 1, wherein the extension mechanism is a collapsing mechanism configured to collapse the basketball net into the storage space through the opening in the housing.

10. A method for attaching a basketball net to a lower side of a basketball hoop and for removing the basketball net from the lower side of a basketball hoop, the method comprising the steps of:

providing a basketball net comprising a plurality of attachment members configured for releasable attachment of the basketball net to a lower side of a basketball hoop;

providing a device for placing the basketball net relative to the basketball hoop, the device comprising:

a housing having a storage space configured to store the basketball net, wherein the basketball net is stored in the storage space; and an extension mechanism configured to extend the basketball net from the storage space through an opening in the housing; and extending the basketball net with the extension mechanism from the storage space through the opening in the housing towards the basketball hoop to releasably attach the plurality of attachment members to the lower side of the basketball hoop.

11. The method according to claim 10, further comprising the step of retracting the basketball net from the basketball hoop using the retraction mechanism.

12. The method according to claim 10, further comprising the step of operating the extension mechanism as a collapsing mechanism to collapse the basketball net into the storage space through the opening in the housing.

* * * * *